US009568850B2

(12) United States Patent
Oki et al.

(10) Patent No.: US 9,568,850 B2
(45) Date of Patent: Feb. 14, 2017

(54) POSITIVELY CHARGEABLE TONER, LIQUID DEVELOPER, DEVELOPER, DEVELOPER CARTRIDGE, PROCESS CARTRIDGE, AND IMAGE FORMING METHOD

(71) Applicant: FUJI XEROX CO., LTD., Tokyo (JP)

(72) Inventors: Masahiro Oki, Kanagawa (JP); Akira Imai, Kanagawa (JP); Yoshihiro Inaba, Kanagawa (JP); Takako Kobayashi, Kanagawa (JP); Daisuke Yoshino, Kanagawa (JP); Hiroyuki Moriya, Kanagawa (JP); Koji Horiba, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 32 days.

(21) Appl. No.: 14/594,868

(22) Filed: Jan. 12, 2015

(65) Prior Publication Data

US 2016/0026106 A1 Jan. 28, 2016

(30) Foreign Application Priority Data

Jul. 24, 2014 (JP) ..... 2014-150825

(51) Int. Cl.

| | |
|---|---|
| ***G03G 9/097*** | (2006.01) |
| ***G03G 9/135*** | (2006.01) |
| ***G03G 21/18*** | (2006.01) |

(52) U.S. Cl.

CPC ..... *G03G 9/135* (2013.01); *G03G 9/09741* (2013.01); *G03G 9/09775* (2013.01); *G03G 9/1355* (2013.01); *G03G 21/18* (2013.01)

(58) Field of Classification Search

CPC ... G03G 9/135; G03G 9/1355; G03G 9/09775

USPC ..... 430/108.22, 115

See application file for complete search history.

(56) References Cited

U.S. PATENT DOCUMENTS

| | | | | |
|---|---|---|---|---|
| 2006/0099530 | A1 | 5/2006 | Lee et al. | |
| 2008/0090162 | A1 | 4/2008 | Tsunemi | |
| 2009/0214976 | A1* | 8/2009 | Teshima | G03G 9/12 430/115 |
| 2010/0014894 | A1 | 1/2010 | Ueno et al. | |
| 2010/0015543 | A1 | 1/2010 | Oki et al. | |
| 2010/0068478 | A1* | 3/2010 | Humpert | G03G 9/12 428/195.1 |
| 2010/0323291 | A1* | 12/2010 | Maeda | G03G 9/1355 430/113 |
| 2014/0106273 | A1* | 4/2014 | Sugawara | G03G 15/08 430/109.3 |

FOREIGN PATENT DOCUMENTS

| | | | |
|---|---|---|---|
| JP | 07042432 | B2 * | 5/1995 |
| JP | 2007-509360 | A | 4/2007 |
| JP | 2008-096980 | A | 4/2008 |
| JP | 2010-181595 | A | 8/2010 |
| JP | 5115379 | B2 | 1/2013 |
| JP | 5176733 | B2 | 4/2013 |
| KR | 20100079033 | A * | 7/2010 |

OTHER PUBLICATIONS

English language machine translation of JP 07-07042432 B2 (May 1995).*

English language machine translation of KR 2010-0079033 A (Jul. 2010).*

* cited by examiner

*Primary Examiner* — Christopher Rodee

(74) *Attorney, Agent, or Firm* — Oliff PLC

(57) ABSTRACT

A positively chargeable toner includes at least a binder resin, and toner particles of which surfaces are modified by a polyvinylamine compound.

10 Claims, 1 Drawing Sheet

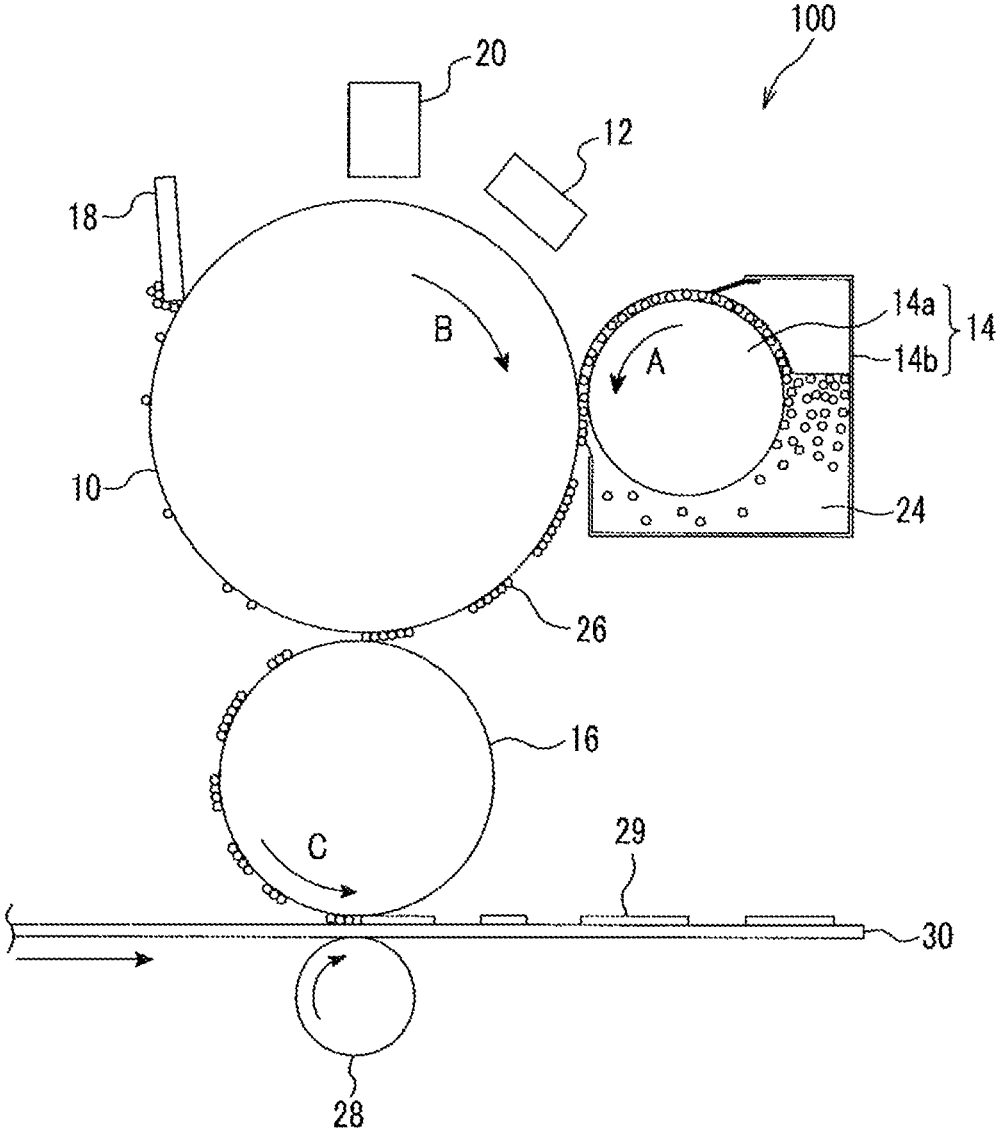
100
20
12
18
B
A
14a
14
14b
10
24
26
16
C
29
30
28

POSITIVELY CHARGEABLE TONER, LIQUID DEVELOPER, DEVELOPER, DEVELOPER CARTRIDGE, PROCESS CARTRIDGE, AND IMAGE FORMING METHOD

CROSS-REFERENCE TO RELATED APPLICATIONS

This application is based on and claims priority under 35 USC 119 from Japanese Patent Application No. 2014-150825 filed Jul. 24, 2014.

BACKGROUND

1. Technical Field

The present invention relates to a positively chargeable toner, a liquid developer, a developer, a developer cartridge, a process cartridge, and an image forming method.

2. Related Art

A method of visualizing image information though an electrostatic charge image such as an electrophotography method is currently used in many fields. In the electrophotography method, a latent image (electrostatic latent image) is formed on an image holding member in charging and exposure steps (latent image forming step), and the latent image is visualized by developing an electrostatic latent image with an electrostatic charge image developer (hereinafter, simply referred to as a "developer" in some cases) including an electrostatic charge image developing toner (hereinafter, simply referred to as a "toner" in some cases) (development step), and performing a transfer step and a fixation step. As a developer used in a dry development method, a two-component developer made with a toner and a carrier, and a single component developer in which a magnetic toner or a non-magnetic toner is singly used are included.

Meanwhile, a liquid developer used in a wet development method is obtained by dispersing toner particles in an insulating carrier liquid. A type in which toner particles including a thermoplastic resin are dispersed in a volatile carrier liquid, a type in which toner particles including a thermoplastic resin are dispersed in a hardly volatile carrier liquid, and the like are known.

SUMMARY

According to an aspect of the invention, there is provided a positively chargeable toner including:

at least a binder resin; and toner particles of which surfaces are modified by a polyvinylamine compound.

BRIEF DESCRIPTION OF THE DRAWING

Exemplary embodiments of the present invention will be described in detail based on the following FIGURE, wherein:

The FIGURE is a diagram schematically illustrating a configuration of an example of image forming apparatus according to an exemplary embodiment of the invention.

DETAILED DESCRIPTION

Exemplary embodiments of the invention are described below. The exemplary embodiments are provided as examples, and the invention is not limited thereto.

Positively Chargeable Toner

A positively chargeable toner according to the exemplary embodiment of the invention (hereinafter, simply referred to as a "toner") includes at least a binder resin, and contains toner particles of which the surfaces are modified with a polyvinylamine compound. The toner particles may include other components such as a colorant or a release agent, if necessary.

The binder resin which is generally used in the toner is a polyester resin or a styrene/acrylic resin, but the polyester resin is easily negatively chargeable, and has excellent fixing properties and excellent color developing properties so that the polyester resin tends to be negatively chargeable easily. In addition, if a silicone carrier liquid and a polyester resin having excellent fixing properties are combined as the liquid developer, the liquid developer is difficult to be positively chargeable.

The charging mechanism of the liquid development is basically different from a mechanism of the dry toner using the triboelectric charging. The general positively chargeable mechanism in the liquid development is to positively charge toner particles themselves by causing protons intentionally introduced to the carrier liquid to be adsorbed into proton receiving layers on the surfaces of the toner particles. Therefore, the design of the proton receiving layers on the surfaces of the toner particles becomes very important, and the design thereof determines the characteristics of the liquid developer. However, in the liquid developer according to the related art, molten kneaded dispersions are mixed into a carrier so that a dispersant, a charge-controlling agent, and the like are added to be turned into developers by bead mills or the like. Therefore, it is difficult to intentionally provide the proton receiving layers on the surfaces of the toner particles, there are not many kinds of materials that may be used as the dispersants, the charge-controlling agents, and the like, and the solubility to the carrier liquid is low.

As the commercially available charge-controlling agent for positive charging, a nigrosine dye, such as "Bontron N-01", "Bontron N-04", and "Bontron N-07" (all manufactured by Orient Chemical Industries Co., Ltd.), "CHUO CCA-3" (manufactured by Chuo Synthetic Chemical Co., Ltd.); a triphenylmethan dye containing tertiary amine as a branch; a quaternary ammonium salt compound such as "Bontron P-51" (manufactured by Orient Chemical Industries Co., Ltd.), or "TP-415" (manufactured by Hodogaya Chemical Co., Ltd.), and cetyltrimetylammonium bromide, "COPY CHARGE PX VP435" (manufactured by Clariant, Ltd.) are included. However, the charge-controlling agent that may be applied to a color toner is only a colorless quaternary ammonium salt compound, and since the others are colored, they may be applied to only a black color toner. In addition, the positively chargeable charge-controlling agent as described above may be effective when being applied to a dry toner, but has little effect when being applied to a liquid toner. As the liquid toner positively chargeable charge-controlling agent, an amine material such as Solsperse 13940/11200 or Antaron V220 is added in many cases, but types of applicable materials are very few, and the solubility in a carrier liquid is low. Therefore, sufficient positively charging properties may not be obtained in many cases.

The charging of the liquid developer toner may be controlled, in most cases, by adding an amine material such as Solsperse 13940, Solsperse 11200, Antaron V220, and Antaron 216 when the developer is formed. However, types of applicable materials are very few, and sufficient charging properties may not be obtained especially when silicone oil is used as the carrier liquid. In addition, according to the method in the related art, the charge-controlling material is added when molten kneading is performed or when the developer is manufactured by using a disperser such as a bead mill. However, according to this method, the charge-controlling material is easily separated from the surfaces of the toner particles, and charging stability is low.

The inventors have found that a dry toner or a liquid developer toner with excellent positively charging properties is obtained by modifying surfaces of toner particles with the polyvinylamine compound. It is considered that since the polyvinylamine compound is highly cationic materials and function as a proton receiving layer if the polyvinylamine compound exists on the surfaces of the toner particles, toner particles may be easily positively chargeable. If the polyvinylamine compound is chemically adsorbed into the surfaces of the toner particles by an acid-base reaction, it is considered that the possibility that the polyvinylamine compound is separated from the surfaces of the toner particles becomes very low, and stable positively charging properties may be obtained. In addition, since the surfaces of the toner particles are covered with the polyvinylamine compound, the toner particles are not easily influenced by the charging of a binder resin or a colorant. Accordingly, the positively charging may be performed even by combining a silicone carrier liquid and the binder resin such as a polyester resin which is not easily positively chargeable is used as a liquid developer. In addition, since the polyvinylamine compound may be used when paper is manufactured, if the polyvinylamine compound is present on the surfaces of the toner particles, adhesive properties to paper are enhanced. Since the polyvinylamine compound is substantially colorless and transparent, the polyvinylamine compound may be applied to color toners.

Polyvinylamine Compound

The polyvinylamine compound is a polymer including at least vinylamine as a constitutional monomer. The polyvinylamine compound may be obtained by polymerizing N-vinyl formamide, adding ammonia, primary amine, or secondary amine, and the like to an N-vinyl formamide polymer, and performing basic hydrolysis by using hydroxide of alkali metal or alkaline-earth metal.

The polyvinylamine compound may include N-vinyl formamide, N-vinylphthalimide, N-vinylacetamide, and the like, in addition to vinylamine, as the constitutional monomer.

Polyvinylamine represented by Formula (1) below is preferably used as the polyvinylamine compound. Polyvinylamine represented by Formula (1) below is a polymer including vinylamine and N-vinyl formamide as the constitutional monomer.

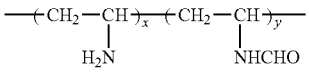

(1)

In Formula (1), x and y are independently integers equal to or greater than 1, respectively. In addition, x and y are preferably independently integers equal to or less than 7,000, respectively. In Formula (1), the ratio of x:y is in the range of 99:1 to 1:99.

In Formula (1), the amino group (—$NH_2$) may have a salt structure such as hydrochloride or sulphate.

A weight average molecular weight of the polyvinylamine compound is preferably in the range of 1,000 to 300,000, and more preferably in the range of 1,000 to 200,000. If the weight average molecular weight of the polyvinylamine compound is less than 1,000, desired positively charging properties may not be obtained in some cases, and if the weight average molecular weight of the polyvinylamine compound exceeds 300,000, the fixing properties may be deteriorated.

The polyvinylamine compound is preferably alkaline. If the polyvinylamine compound is alkaline, it is considered that an acid-base reaction is likely to be performed with the surfaces of the toner particles which are acidic so that chemical adsorption may occur. In this case, pH when the polyvinylamine compound is dissolved in water is preferably in the range of 8 to 14.

As the polyvinylamine compound, a commercially available material may be used. As an example of commercially available polyvinylamine, PVAM-0595B (manufactured by Mitsubishi Rayon Co., Ltd.) is included. In addition, PVAM-0570B or KP8040 (manufactured by Mitsubishi Rayon Co., Ltd.), Lupamin 1500, Lupamin 1595, Lupamin 3095, Lupamin 4595, and Lupamin 9095 (manufactured by BASF SE), and the like which are copolymers of vinylamine and N-vinyl formamide also may be applied.

The content of the polyvinylamine compound is preferably in the range of 0.1% by weight to 3% by weight with respect to all toner particles, and more preferably in the range of 0.1% by weight to 2% by weight. If the content of the polyvinylamine compound is less than 0.1% by weight, sufficient positively charging properties may not be obtained, and developing properties are decreased, and if the polyvinylamine compound is used as the liquid developer, dispersion stability and recycling properties may decrease. In addition, if the content of the polyvinylamine compound exceeds 3% by weight, the positively charging properties become too high so that the toner is not likely to be transferred from a photoreceptor, and developing properties may decrease.

Binder Resin

The binder resin is not particularly limited, but, for example, a styrene-acryl resin such as polyester, polystyrene, a styrene-alkyl acrylate copolymer or a styrene-alkyl methacrylate copolymer, a styrene-acrylonitrile copolymer, a styrene-butadiene copolymer, a styrene-maleic anhydride copolymer, polyethylene, and polypropylene are included. Further, polyurethane, an epoxy resin, a silicone resin, polyamide, modified rosin, paraffin wax, and the like are included. Among them, in view of fixing properties, a polyester resin and a styrene-acryl resin are preferable, and a polyester resin is more preferable. As the binder resins, the above resins may be used singly, or two or more kinds thereof may be used by mixture.

As described above, the binder resin preferably includes a polyester resin as a main component. The polyester resin is obtained by synthesis from an acid (polyvalent carboxylic acid) component and an alcohol (polyol) component. According to the exemplary embodiment, an "acid-derived constitutional component" refers to a structural portion which is an acid component before a polyester resin is synthesized, and an "alcohol-derived constitutional component" refers to a structural portion which is an alcohol component before the polyester resin is synthesized. A main component refers to a component that is equal to or greater than 50 parts by weight with respect to 100 parts by weight of the binder resin in the toner particles.

Acid-Derived Constitutional Component

The acid-derived constitutional component is not particularly limited, and an aliphatic dicarboxylic acid and an aromatic carboxylic acid are preferably used. As the aliphatic dicarboxylic acid, for example, an oxalic acid, a malonic acid, a succinic acid, a glutaric acid, an adipic acid, a pimelic acid, a suberic acid, an azelaic acid, a sebacic acid, a 1,9-nonanedicarboxylic acid, a 1,10-decanedicarboxylic acid, a 1,11-undecanedicarboxylic acid, a 1,12-dodecanedicarboxylic acid, a 1,13-tridecanedicarboxylic acid, a 1,14-tetradecanedicarboxylic acid, a 1,16-hexadecanedicarboxylic acid, and a 1,18-octadecanedicarboxylic acid, or lower alkyl esters thereof or acid anhydrides thereof are included, but not limited thereto. In addition, as the aromatic carboxylic acid, for example, lower alkyl esters or acid anhydrides of an aromatic carboxylic acid such as a terephthalic acid, isophthalic acid, an anhydrous phthalic acid, an anhydrous trimellitic acid, a pyromellitic acid, and a naphthalene dicarboxylic acid are included. In addition, an alicyclic carboxylic acid such as a cyclohexanedicarboxylic acid is included. Further, it is preferable to use tri- or higher valent carboxylic acids (trimellitic acids or acid anhydrides thereof) together with the dicarboxylic acid in order to obtain a crosslinked structure or a branched structure for obtaining good fixing properties. In addition, specific examples of alkenylsuccinic acids described above include a dodecenylsuccinic acid, a dodecylsuccinic acid, a stearylsuccinic acid, an octylsuccinic acid, an octenylsuccinic acid, and the like.

Alcohol-Derived Constitutional Component

The alcohol-derived constitutional component is not particularly limited, and as aliphatic diol, for example, ethyleneglycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, 1,20-eicosanediol are included. In addition, diethyleneglycol, triethyleneglycol, neopentylglycol, glycerin, alicyclic dials such as cyclohexanediol, cyclohexanedimethanol, and hydrogenated bisphenol A, and aromatic diols such as an ethylene oxide adduct of bisphenol A and a propylene oxide adduct of bisphenol A are used. In addition, in order to obtain a crosslinked structure or a branched structure for securing good fixing properties, tri- or higher valent polyol (glycerin, trimethylolpropane, pentaerythritol) may be used together with dial.

The method of preparing the polyester resin is not particularly limited, and the polyester resin may be prepared in a general polyester polymerization method in which an acid component and an alcohol component are reacted. For example, direct polycondensation and an ester exchanging method are included, and the preparing method may be used depending on types of monomers. When the acid component and the alcohol component are reacted, a mole ratio (acid component/alcohol component) is different depending on reaction conditions, but is generally about 1/1.

The polyester resin may be manufactured in the polymerization temperature range of 180° C. to 230° C., and the reaction may be performed while the reaction system is decompressed, and water or alcohol generated at the time of the condensation is removed, if necessary. If the monomer is not dissolved or compatible under the reaction temperature, a polymerization reaction becomes partially fast or slow so as to generate a lot of uncolored particles. Therefore, a solvent with a high boiling point may be added as a solubilizing agent to dissolve the monomer. The polycondensation reaction may be performed while the solvent as a solubilizing agent is distilled. In the copolymerization reaction, if a poorly compatible monomer exists, the poorly compatible monomer and acid or alcohol to be polycondensed with the monomer are condensed in advance, and then the polycondensation is performed with the main component.

As the catalyst to be used in the preparing of the polyester resin, an alkali metal compound such as sodium and lithium; an alkaline-earth metal compound such as magnesium or calcium; a metal compound such as zinc, manganese, antimony, titanium, tin, zirconium, or germanium; a phosphoric acid compound, a phosphorous acid compound, and an amine compound, and the like are included. Among them, for example, a tin containing catalyst such as tin, tin formate, tin oxalate, tetraphenyl tin, dibutyltin dichloride, dibutyltin oxide, or diphenyltin oxide is preferably used.

According to the exemplary embodiment, a compound with a hydrophilic polar group may be used, as long as the compound may be copolymerized as a resin for an electrostatic charge image developing toner. Specifically, if the resin used is polyester, a dicarboxylic acid compound in which a sulphonyl group is directly substituted for an aromatic ring such as sulphonyl-sodium terephthalate salt, and 3-sulphonyl sodium isophthalate salt are included.

A weight average molecular weight Mw of the polyester resin is preferably equal to or greater than 5,000, and more preferably in the range of 5,000 to 50,000. If the polyester resin is included, scraping properties are superior. If the weight average molecular weight Mw of the polyester resin may be less than 5,000, the polyester resin may be easily separated depending on the circumstances, and thus problems caused by isolated resins (filming, increase of fine powders caused by fragility, deterioration of powder fluidity, and the like) may occur.

In the toner according to the exemplary embodiment, a resin other than the polyester resin is not particularly limited, and specifically, a homopolymer of a monomer styrenes such as styrene, p-chlorostyrene, or α-methylstyrene; an acrylic monomer such as methyl acrylate, ethyl acrylate, n-propyl acrylate, butyl acrylate, lauryl acrylate, or 2-ethylhexyl acrylate; a methacrylic monomer such as methyl methacrylate, ethyl methacrylate, n-propyl methacrylate, lauryl methacrylate, or 2-ethylhexyl methacrylate; an ethylenic unsaturated acid monomer such as acrylic acid, methacrylic acid, or sodium styrenesulfonate; vinyl nitriles such as acrylonitrile or methacrylonitrile; vinyl ethers such as vinyl methyl ether or vinyl isobutyl ether; vinyl ketones such as vinyl methyl ketone, vinyl ethyl ketone, or vinyl isopropenyl ketone; olefins such as ethylene, propylene, or butadiene, a copolymer obtained by combining two or more types of these monomers, or a mixture thereof, a non-vinyl condensation resin such as an epoxy resin, a polyester resin, a polyurethane resin, a polyamide resin, a cellulose resin, and a polyether resin, a mixture of the vinyl resin with these, or a graft polymer obtained by polymerizing a vinyl monomer under coexistence of these is included. The resins may be used singly, or two or more types thereof may be used in combination.

The content of the binder resin is, for example, in the range of 65% by weight to 95% by weight with respect to all toner particles.

An acid value of the binder resin is preferably in the range of 1 mg KOH/g to 30 mg KOH/g, and more preferably in the range of 7 mg KOH/g to 20 mg KOH/g. If the acid value of the binder resin is less than 1 mg KOH/g, a particle surface adsorption amount of the polyvinylamine compound used as a surface modifying agent decreases. Therefore, a desired positively charge amount may not be obtained, or granulation properties may be deteriorated when granulation is performed by using phase-transfer emulsification. If the acid value of the binder resin exceeds 30 mg KOH/g, even if the polyvinylamine compound is adsorbed onto the particle surfaces, the positively charging properties may be deteriorated.

Other Components

The toner particles according to the exemplary embodiment may include a colorant, and also additives such as a release agent, a charge-controlling agent, silica powder, and metal oxide, if necessary. These additives may be internally added by being kneaded and mixed into the binder resin, or be externally added by performing a mixing process after toner particles are obtained as the particles.

The colorant is not particularly limited, and a well-known pigment is used, and a well-known dye may be added, if necessary. Specifically, respective pigments such as yellow, magenta, cyan, and black, described below, are used.

As the yellow pigment, a compound represented by a condensed aso compound, an isoindolinone compound, an anthraquinone compound, an aso metal complex compound, a methine compound, an allyl amide compound, and the like are used.

As the magenta pigment, a condensed aso compound, a diketopyrrolopyrrole compound, anthraquinone, a quinacridone compound, a basic dye lake compound, a naphthol compound, a benzimidazolone compound, a thioindigo compound, a perylene compound, and the like are used.

As the cyan pigment, a copper phthalocyanine compound and a derivative thereof, an anthraquinone compound, a basic dye lake compound, and the like are used.

As the black pigment, carbon black, aniline black, acetylene black, iron black, and the like are used.

The content of the colorant is, for example, in the range of 1% by weight to 20% by weight with respect to all toner particles.

The release agent is not particularly limited, and, for example, plant wax such as carnauba wax, Japan wax, and rice bran wax; animal wax such as beeswax, insect wax, whale wax, and wool wax; mineral wax such as montan wax and ozoketrite, Fischer Tropsch Wax (FT wax) having aster in a branch, synthesized fatty acid solid ester wax such as special fatty acid ester and polyol ester; and synthetic wax such as paraffin wax, polyethylene wax, polypropylene wax, polytetrafluoroethylene wax, polyamide wax, and a silicone compound; and the like are included. The release agents may be used singly, or two or more types thereof may be used in combination.

The content of the release agent is, for example, in the range of 0.1% by weight to 15% by weight with respect to all toner particles.

The charge-controlling agent is not particularly limited, and a well-known charge-controlling agent in the related art is used. For example, a positively chargeable charge-controlling agent such as a nigrosine dye, a fatty acid-modified nigrosine dye, a carboxyl group-containing fatty acid-modified nigrosine dye, quaternary ammonium salt, an amine compound, an amide compound, an imide compound, and an organic metal compound; and a negatively chargeable charge-controlling agent such as a metal complex of oxycarboxylic acid, a metal complex of azo compound, a metal complex salt dye, and a salicylic acid derivative; are included. The charge-controlling agent may be used singly, or two or more types thereof may be used.

The metal oxide is not particularly limited, and, for example, titanium oxide, aluminum oxide, magnesium oxide, zinc oxide, strontium titaniate, barium titaniate, magnesium titaniate, and calcium titaniate are included. The metal oxides may be used singly, or two or more types thereof may be used.

Method of Preparing Toner Particles

The method of preparing toner particles used in the exemplary embodiment is not particularly limited, and, for example, a wet preparing method such as a kneading and pulverizing method, an in-liquid emulsifying method, or a polymerization method is included.

For example, a binder resin, if necessary, a colorant, and other additives are input and mixed in a Henschel mixer, are molten kneaded with a twin screw extruder, a Banbury mixer, a roll mill, a kneader, or the like, are cooled with a drum flaker, are coarsely pulverized with a pulverizer such as a hammer mill, are further pulverized with a pulverizer such as a jet mill, and are classified with a wind classifier or the like so that a pulverized toner is obtained.

In addition, an in-liquid emulsified dry toner may be obtained by filtering and drying particles obtained by dissolving the binder resin, and if necessary, the colorant, and other additives in a solvent such as ethyl acetate, emulsifying and suspending the resultant in water in which a dispersion stabilizer such as calcium carbonate is added, removing the solvent, and then removing a dispersion stabilizer.

In addition, the polymerized toner may be obtained by adding and granulating a composition containing a polymerizable monomer that forms the binder resin, a colorant, a polymerization initiating agent (for example, benzoyl peroxide, lauryl peroxide, isopropyl peroxycarbonate, cumene hydroperoxide, 2,4-dichlorobenzoyl peroxide, and methyl ethyl ketone peroxide), other additives, and the like in water phase while stirring, performing polymerization, filtering particles, and drying the particles.

In addition, the combination ratio of respective materials (binder resin, colorant, other additives, and the like) at the time of obtaining the toner may be set depending on required characteristics, low temperature fixing properties, colors, and the like. The toner particles for a liquid developer according to the exemplary embodiment may be obtained by pulverizing the obtained toner in carrier oil by using a well-known pulverizing apparatus such as a ball mill, a bead mill, and a high-pressure wet atomizing apparatus.

Surface Modification Method

Surface modified toner particles according to the exemplary embodiment are manufactured by a method including a step of forming polyvinylamine layers that cover surfaces of the toner particles by modifying the surfaces of the toner particles with the polyvinylamine compound. Since the polyvinylamine compound is a water soluble polymer, the polyvinylamine compound may be adsorbed into the surfaces of the toner particles without change after water washing performed before a drying step in the wet preparing method which granulates particles in a liquid. In the specific processing method, the surfaces of the toner particles are set to be in an acidic state by adjusting a pH value of a slurry of the toner particles after washing to pH 2 to 5, excessive acids are removed by washing with ion exchanged water, and the polyvinylamine compound is added to the slurry so as to cause the polyvinylamine compound to be chemically adsorbed into the surfaces of the toner particles by the acid-base reaction. Thereafter, unreacted polyvinylamine compound is removed by being washed with ion exchanged water.

The surface modification of the toner particles is performed, specifically in the method below. (1) an acid (hydrochloric acid or nitric acid of about 1 N) is added to the slurry containing the toner particles and water, and a pH value is adjusted to about pH 2 to 5, so that acid sites on the surfaces of the toner particles are restored to an acidic state as much as possible, (2) solid-liquid separation is performed by performing washing with ion exchanged water or the like, or performing centrifugation so that excessive acids are removed, (3) water soluble polyvinylamine compound is added after the re-slurry, and are stirred, for example, at a liquid temperature of about 20° C. to 35° C. for 30 minutes to 60 minutes (4) excessive polyvinylamine compound is removed by performing the solid-liquid separation by washing with ion exchanged water and the like or centrifugation (for example, until conductivity becomes equal to or less than about 20 μS/cm), and (5) the resultant is dried after filtration (for example, at about 35° C., for at least about 24 hours, until moisture percentage is equal to or less than 1%), and is crushed.

When the polyester resin with the acid value of about 10 is used as the binder resin of the toner particles, and the toner particles are granulated by using phase inversion emulsification, since the filtrate after washing is alkaline, it is considered that acid sites on the surfaces of the toner particles (for example, a —COOH group) are neutralized, and many portions of the toner particles have salt structures (for example, $—COO^-Na^+$ and $—COO^-NH_4^+$). Accordingly, it is preferable that the salt structures on the surfaces of the toner particles be restored to acid (for example, a —COOH group) by performing Step (1) so that the polyvinylamine compound may be more easily adsorbed in the acid-base reaction. However, Step (1) or (2) is not essential, and may be omitted if a desired positively charge amount may be obtained.

Characteristics of Toner Particles

A volume average particle diameter of the positively chargeable toners according to the exemplary embodiment is preferably in the range of 3 μm to 8 μm, and more preferably in the range of 3 μm to 7 μm. In addition, a number average particle diameter is preferably in the range of 2 μm to 7 μm, and more preferably in the range of 2 μm to 6 μm.

The volume average particle diameter and the number average particle diameter are measured by using Coulter Multisizer II (manufactured by Beckman Coulter Inc.) with an aperture diameter of 50 μm. At this point, the measurement is performed after the toner is dispersed in an electrolyte aqueous solution (isotonic aqueous solution) for 30 seconds with ultrasonic waves.

Developer

A dry developer according to the exemplary embodiment is not limited as long as the dry developer contains the positively chargeable toner according to the exemplary embodiment, and may be composed with proper components according to purpose. The developer according to the exemplary embodiment becomes a single component developer if the positively chargeable toner is used singly, and becomes a two-component developer if the positively chargeable toner is used in combination with a carrier.

For example, if the carrier is used, the carrier is not particularly limited. Well-known carriers themselves are included, for example, well-known carriers such as resin coated carriers disclosed in JP-A-62-39879, and JP-A-56-11461 are included.

As specific examples of carriers, the following resin-coated carriers are included. As core particles of the carrier, general iron powder, ferrite, magnetite molding, and the like are included; the volume average particle diameter thereof is in the range of about 30 μm to 200 μm.

In addition, as the coating resin of the resin coated carrier, for example, homopolymer of styrenes such as styrene, p-chlorostyrene, and α-methylstyrene; α-methylene fatty acid monocarboxylic acids such as methyl acrylate, ethyl acrylate, n-propyl acrylate, lauryl acrylate, 2-ethylhexyl acrylate, methyl methacrylate, n-propyl methacrylate, lauryl methacrylate, and 2-ethylhexyl methacrylate; nitrogen-containing acryls such as dimethylaminoethyl methacrylate; vinyl nitriles such as acrylonitrile and methacrylonitrile; vinylpyridines such as 2-vinylpyridine and 4-vinylpyridine; vinyl ethers such as vinyl methyl ether and vinyl isobutyl ether; vinyl ketones such as vinylmethylketone, vinylethylketone, and vinyl isopropenyl ketone; olefins such as ethylene and propylene; and vinyl fluorine-containing monomer such as vinylidene fluoride, tetrafluoro ethylene, and hexafluoro ethylene; and copolymers formed of two or more types thereof are included. Further, a silicone resin including methyl silicone, or methyl phenyl silicone, polyesters containing bisphenol and glycol, an epoxy resin, a polyurethane resin, a polyamide resin, a cellulose resin, a polyether resin, and a polycarbonate resin are included. These resins may be used singly or two or more types thereof may be used in combination. A coating amount of the coating resin is preferably in the range of 0.1 parts by weight to 10 parts by weight with respect to 100 parts by weight of the core particles, and more preferably in the range of 0.5 parts by weight to 3.0 parts by weight.

In the preparation of the carrier, a heating-type kneader, a heating-type Henschel mixer, a UM mixer, and the like may be used. According to an amount of the coating resin, a heating-type fluidized tumbling bed, a heating-type kiln, and the like may be used.

The mixing ratio between the positively chargeable toner according to the invention and the carrier in the developer is not particularly limited, and may be appropriately selected according to a purpose.

Liquid Developer

The liquid developer according to the exemplary embodiment is not particularly limited as long as the liquid developer contains the positively chargeable toner according to the exemplary embodiment and a carrier liquid, and may be composed with proper components according to a purpose.

Carrier Liquid

A carrier liquid is an insulating liquid for dispersing toner particles, and is not particularly limited. For example, aliphatic hydrocarbon solvent including aliphatic hydrocarbon such as paraffin oil as a main component (Moresco White MT-30P, Moresco White P40, and Moresco White P70 manufactured by Matsumura Oil. Co. Ltd., Isopar L and Isopar M manufactured by Exxon Mobil Corporation and the like, as commercially available products), a hydrocarbon solvent such as naphthene oil (Exxsol D80, Exxsol D110, and Exxsol D130 manufactured by ExxonMobil Chemical Company, and Naphthesol L, Naphthesol M, Naphthesol H, New Naphthesol 160, New Naphthesol 200, New Naphthesol 220, and New Naphthesol MS-20P manufactured by Nippon Petrochemicals Co., Ltd. as commercially available products) are included. An aromatic compound such as toluene and the like may be contained therein. In addition, silicone oil such as dimethyl silicone, methyl phenyl silicone, and methylhydrogen silicone (silicone solvent) are included. Among these, in view of obtaining image intensity, silicone oil is preferable.

The carrier liquid included in the liquid developer according to the exemplary embodiment may be one type, or may be two or more types. If two or more types of carrier liquids are used by mixture, a mixture of a paraffin solvent and plant oil and a mixture of a silicone solvent and plant oil are included.

For example, the volume resistivity of the carrier liquid is in the range of $1.0\times10^{10}$ Ω·cm to $1.0\times10^{14}$ Ω·cm, and may be in the range of $1.0\times10^{10}$ Ω·cm to $1.0\times10^{13}$ Ω·cm.

The carrier liquid may include various types of auxiliary materials, for example, a dispersant, an emulsifying agent, a surfactant, a stabilizer, a wetting agent, a thickening agent, a foaming agent, an antifoaming agent, a coagulant, a gelling agent, an anti-settling agent, a charge-controlling agent, an antistatic agent, an antioxidant, a softening agent, a plasticizer, a filler, a flavoring agent, an adhesion-preventing agent, and a release agent.

Method of Preparing Liquid Developer

The liquid developer according to the exemplary embodiment may be obtained by mixing and pulverizing the toner particles and a carrier liquid using a disperser such as a ball mill, a sand mill, an attritor, and a bead mill and dispersing the toner particles in the carrier liquid. In addition, the dispersion of the toner particles in the carrier liquid is not limited to method using the disperser, and the dispersion may be performed by rotating special stirring blades at a high speed, by shearing force of a rotor and stator known as a homogenizer, or by ultrasonic waves.

In view of appropriately controlling a viscosity of the developer and smoothly circulating the developer in a developing machine, a concentration of the toner particles in the carrier liquid is preferable in the range of 0.5% by weight to 40% by weight, and more preferably in the range of 1% by weight to 30% by weight.

Thereafter, the obtained dispersionis filtered with a filter such as a film filter with a pore diameter of about 100 μm to remove waste and coarse particles.

Developer Cartridge, Process Cartridge, Image Forming Apparatus, and Image Forming Method An image forming apparatus according to the exemplary embodiment includes, for example, an image holding member (hereinafter, also referred to as a "photoreceptor"), an charging unit that charges a surface of the image holding member, a latent image forming unit that forms a latent image (electrostatic latent image) on a surface of the image holding member, a development unit that forms a toner image by developing the latent image formed on the surface of the image holding member by the liquid developer or the developer according to the exemplary embodiment, a transfer unit that transfers the toner image formed on the surface of the image holding member to a recording medium, and a fixation unit that forms a fixed image by fixing the toner image transferred to the recording medium on the recording medium.

In addition, an image forming method according to the exemplary embodiment includes, for example, a latent image forming step that forms a latent image on a surface of an image holding member, a development step of forming a toner image by developing the latent image formed on the surface of the image holding member with the liquid developer or the developer according to the exemplary embodiment, a transfer step of transferring the toner image formed on the surface of the image holding member to a recording medium, and a fixation step of forming a fixed image by fixing the toner image transferred to the recording medium on the recording medium.

In the image forming apparatus, a portion including a development unit may be, for example, a cartridge structure (process cartridge) which is detachable from a main body of the image forming apparatus. The process cartridge is not particularly limited as long as the process cartridge accommodates the liquid developer or the developer according to the exemplary embodiment. The process cartridge includes a development unit that accommodates the liquid developer or the developer according to the exemplary embodiment, develops the latent image formed on the image holding member with the liquid developer or the developer and forms the toner image, and is detachable from the image forming apparatus.

In addition, the developer cartridge according to the exemplary embodiment is not particularly limited as long as the developer cartridge accommodates the liquid developer or the developer according to the exemplary embodiment. The developer cartridge is detachable from an image forming apparatus including the development unit that accommodates the liquid developer or the developer according to the exemplary embodiment, and forms a toner image by developing the latent image formed on the image holding member with the liquid developer.

Hereinafter, the image forming apparatus using the liquid developer according to the exemplary embodiment is described as an example with reference to the drawings, but the invention is not limited to this configuration.

The FIGURE is a diagram schematically illustrating a configuration of an example of image forming apparatus according to the exemplary embodiment. An image forming apparatus 100 includes a photoreceptor (image holding member) 10, charging device (charging unit) 20, an exposure device (latent image forming unit) 12, a developing device (development unit) 14, an intermediate transfer member (transfer unit) 16, a cleaner (cleaning unit) 18, and a transfer fixation roller (transfer unit, fixation unit) 28. The photoreceptor 10 has a cylindrical shape, and the charging device 20, the exposure device 12, the developing device 14, the intermediate transfer member 16, and the cleaner 18 are sequentially provided on the outer circumference of the photoreceptor 10.

Hereinafter, operations of the image forming apparatus 100 are described.

The charging device 20 charges the surface of the photoreceptor 10 to a predetermined potential (charging step), and the exposure device 12 forms a latent image (electrostatic latent image) by exposing the charged surface with, for example, laser beam based on an image signal (latent image forming step).

The developing device 14 includes a developing roller **14*a* and a developer accommodating container 14*b*. The developing roller 14*a* is installed so that a portion thereof is dipped in a liquid developer 24 accommodated in the developer container 14*b*. The liquid developer 24** includes insulating carrier liquid, and toner particles including binder resins.

Though the toner particles are dispersed in the liquid developer 24, for example, the positional variation of concentrations of the toner particles in the liquid developer 24 is decreased, for example, by continuously stirring the liquid developer 24 with a stirring member provided in the developer container 14b. Accordingly, the liquid developer 24 in which the positional variation of the concentrations of the toner particles is decreased is supplied to the developing roller 14a that rotates in an arrow A direction in the FIGURE.

The liquid developer 24 supplied to the developing roller **14*a* is transferred to the photoreceptor 10 in a state of being regulated to a certain supply amount by a regulation member, and is supplied to the electrostatic latent image in a position in which the developing roller 14*a* and the photoreceptor 10 are close to each other (or come into contact with each other). Accordingly, the electrostatic latent image is developed to become a toner image 26** (development step).

The developed toner image 26 is transported to the photoreceptor 10 that rotates in an arrow B direction in the FIGURE, and is transferred to paper (recording medium) 30. However, according to the exemplary embodiment, before the toner image is transferred to the paper 30, in order to enhance the transfer efficiency to the recording medium together with the separation efficiency of the toner image from the photoreceptor 10 and to cause the toner image to be fixed at the same time as being transferred to the recording medium, the toner image is once transferred to the intermediate transfer member 16 (intermediate transfer step). At this point, difference in the circumferential speed between the photoreceptor 10 and the intermediate transfer member 16 may be provided.

Subsequently, the toner image transported in an arrow C direction by the intermediate transfer member 16 is fixed at the same time as being transferred to the paper 30 in a contact position with the transfer fixation roller 28 (transfer step and fixation step). The paper 30 is interposed between the transfer fixation roller 28 and the intermediate transfer member 16, and the toner image on the intermediate transfer member 16 is in close contact with the paper 30. Accordingly, the toner image is transferred to the paper 30, and the toner image is fixed on the paper, to be a fixed image 29. It is preferable that the toner image be fixed by providing a heating element on the transfer fixation roller 28 and pressurizing and heating the toner image. The fixation temperature is, generally, in the range of 120° C. to 200° C.

If the intermediate transfer member 16 has a roller shape as illustrated in the FIGURE, the intermediate transfer member 16 and the transfer fixation roller 28 configure a roller pair. Therefore, the intermediate transfer member 16 and the transfer fixation roller 28 respectively correspond to a fixation roller and a pressurization roller in a fixation device, and exhibit a fixing function. That is, if the paper 30 passes through a nip formed between the intermediate transfer member 16 and the transfer fixation roller 28, the toner image is transferred and also is heated and pressurized with respect to the intermediate transfer member 16 by the transfer fixation roller 28. Accordingly, the toner image permeates into fibers of the paper 30 while the binder resins in the toner particles that configure the toner image are softened, so that the fixed image 29 is formed on the paper 30.

According to the exemplary embodiment, the image is transferred to and fixed on the paper 30 at the same time, but the transfer step and the fixation step may be respectively performed so that the image is fixed after being transferred. In this case, the transfer roller that transfers the toner image from the photoreceptor 10 has a function corresponding to the intermediate transfer member 16.

Meanwhile, in the photoreceptor 10 that transfers the toner image 26 to the intermediate transfer member 16, remaining toner particles that are not transferred are moved to a contact position with the cleaner 18, and collected by the cleaner 18. In addition, if the transfer efficiency is near 100%, and the remaining toner does not cause problems, the cleaner 18 may not be provided.

The image forming apparatus 100 may include an erasing device (not illustrated) that erases the surface of the photoreceptor 10 after transfer to next charging.

The charging device 20, the exposure device 12, the developing device 14, the intermediate transfer member 16, the transfer fixation roller 28, the cleaner 18, and the like included in the image forming apparatus 100 may all be operated in synchronization with the rotation speed of the photoreceptor 10, for example.

EXAMPLE

Hereinafter, the invention is more specifically described with reference to examples and comparative examples, but the invention is not limited to the following examples.

Example 1

Preparation of Toner Particles

The toner of Example 1 may be obtained by the following method. That is, a resin particle dispersion, a colorant dispersion, and a release agent dispersion described below are respectively prepared. Subsequently, while predetermined amounts of these are mixed and stirred, a polymer of inorganic metal salt is added thereto, and the obtained material is ionically neutralized, and an aggregate of the respective particles is formed, so that a desired toner particle diameter is obtained. Subsequently, a pH value in a system is adjusted from a weak acidic range to a neutral range with inorganic hydroxide, and the resultant is heated to be equal to or greater than a glass transition temperature of the resin particles, and coalesced. After the reaction, sufficient washing, solid-liquid separation, and a drying step are performed to obtain desired toner particles.

Synthesis of Crystalline Polyester Resin

In a flask, 1,982 parts by weight of sebacic acid, 1,490 parts by weight of ethyleneglycol, 59.2 parts by weight of sodium dimethyl 5-sulfoisophthalate, and 0.8 parts by weight of dibutyltin oxide are reacted at 180° C. for 5 hours under a nitrogen atmosphere, and then the condensation reaction is performed at 220° C. under decompression. Sampling is performed on the polymer in the middle of the reaction, and when molecular weights in a gel permeation chromatography (GPC) satisfies Mw (weight average molecular weight)=20,000, and Mn (number average molecular weight)=8,500, the reaction is stopped, and the crystalline polyester resin is obtained. The dissolution temperature (peak temperature of DSC) is 71° C. The measurement result of the content of sodium dimethyl isophthalate 5-sulfonate by NMR is 1% by mole (with respect to all constitutional components).

Crystalline Polyester Resin Particle Dispersion 160 parts by weight of a crystalline polyester resin, 233 parts by weight of ethyl acetate, and 0.1 parts by weight of an aqueous sodium hydroxide solution (0.3 N) are prepared, these are input to a separable flask, heated to 75° C., stirred with a three-one motor (manufactured by Shinto Scientific Co., Ltd.), and the resin mixture solution is prepared. While the resin mixture solution is further stirred, 373 parts by weight of the ion exchanged water are slowly added, phase inversion emulsification is performed, the temperature is dropped to 40° C. at a temperature dropping rate of 10° C./min, and the crystalline polyester resin particle dispersion (solid content concentration: 30% by weight) is obtained by removing solvent.

Synthesis of Amorphous Polyester Resin

After 200 parts by weight of dimethyl terephthalate, 85 parts by weight of 1,3-butanediol, and 0.3 parts by weight of dibutyltin oxide as a catalyst, are input to a heated and dried two-necked flask, the air in the container is caused to be in an inert atmosphere with nitrogen gas by a decompression operation, and stirring is performed by mechanical stirring at 180 rpm for 5 hours. Thereafter, the temperature is slowly increased to 230° C. under decompression, stirred for 2 hours, air-cooled when the resultant becomes a viscous state, the reaction is stopped, and an amorphous polyester resin (amorphous polyester resin including acid-derived constitutional component in which content of aromatic dicarboxylic acid-derived constitutional component is 100 construction mole %, and alcohol-derived constitutional component in which content of aliphatic diol-derived constitutional component is 100 construction mole %) of 240 parts by weight is synthesized.

As a result of the measurement of the molecular weight with GPC (polystyrene conversion), the weight average molecular weight (Mw) of the obtained amorphous polyester resin (1) is 9,500, and the number average molecular weight (Mn) is 4,200. Also, the DSC spectrum of the amorphous polyester resin (1) is measured by using the differential scanning calorimeter (DSC) described above, to observe the stepwise endothermic quantity change without clear peaks. The glass transition temperature which is regarded as the intermediate point of the stepwise endothermic quantity changes is 55° C. In addition, the resin acid value is 13 mg KOH/g.

Amorphous Polyester Resin Particle Dispersion 160 parts by weight of an amorphous polyester resin (1), 233 parts by weight of ethyl acetate, and 0.1 parts by weight of an aqueous sodium hydroxide solution (0.3 N) are prepared, these are input to a separate flask and heated to 70° C., stirred with a three-one motor (manufactured by Shinto Scientific Co., Ltd.), and the resin mixture solution is prepared. While the resin mixture solution is further stirred, 373 parts by weight of the ion exchanged water are slowly added, phase inversion emulsification is performed, the temperature is dropped to 40° C. at a temperature dropping rate of 1° C./min, and the amorphous polyester resin particle dispersion (solid content concentration: 30% by weight) is obtained by removing solvent.

Preparation of Colorant Dispersion

Cyan pigment (C. I. Pigment Blue 15:3, manufactured by Dainichiseika Color & Chemicals Mfg., Co., Ltd.): 45 parts by weight Ionic surfactant (Neogen R K, manufactured by Daiichi Kogyo Seiyaku Co., Ltd.): 5 parts by weight Ion exchanged water: 200 parts by weight These are mixed and dissolved, the resultant is dispersed for 10 minutes with a homogenizer (IKA Ultra-Turrax), and the colorant dispersion with a volume average particle diameter of 170 nm is obtained.

In the same manner as in the dispersion preparation method of the cyan pigment, a yellow pigment (C. I. Pigment Yellow 74, manufactured by Dainichiseika Color & Chemicals Mfg., Co., Ltd.), a magenta pigment (C. I. Pigment Red 269, manufactured by Dainichiseika Color & Chemicals Mfg., Co., Ltd.), and a black pigment (C. I. Pigment Black 7, manufactured by Mitsubishi Chemical Corporation) are used to obtain respective colorant dispersions.

Preparation of Release Agent Dispersion

Alkyl wax FNP0085 (dissolution temperature of 86° C., manufactured by Nippon Seiro Co., Ltd.) 45 parts by weight Cationic surfactant (Neogen R K, manufactured by Daiichi Kogyo Seiyaku Co., Ltd.): 5 parts by weight Ion exchanged water: 200 parts by weight These are heated to 90° C., the resultant is sufficiently dispersed in IKA Ultra-Turrax T50, a dispersion process with a pressured discharge-type Gaulin homogenizer is performed, and a release agent dispersion with a volume average particle diameter of 200 nm and solid content amount of 24.3% by weight is obtained.

Preparation of Toner

Crystalline polyester resin particle dispersion: 15 parts by weight

Amorphous polyester resin particle dispersion: 80 parts by weight

Colorant dispersion (respectively for Y, M, C, and K): 18 parts by weight

Release agent dispersion: 18 parts by weight

Ion exchanged water is added to the components described above so that the solid content amount becomes 16% by weight, and the resultant is sufficiently mixed and dispersed with Ultra-Turrax T50 in a round stainless steel flask. Subsequently, 0.36 parts by weight of aluminum polychloride are added thereto, and the dispersion operation is continued with Ultra-Turrax. The flask is heated to 47° C. in a heating oil bath under stirring. After being retained at 47° C. for 60 minutes, 46 parts by weight of amorphous polyester resin particle dispersion are slowly added. Thereafter, pH in the system is adjusted to 9.0 by using an aqueous sodium hydroxide solution of 0.55 mol/L, the stainless steel flask is sealed, heated to 90° C. while continuing stirring by using a magnetic seal, and retained thereat for 3.5 hours. At this point, when the particle diameters are measured, the volume average particle diameter is 2.3 μm, the volume average particle size distribution index GSDv is 1.24, and the number average particle size distribution index GSDp is 1.30. Upon completion of reaction, cooling and filtration is performed, sufficient washing with ion exchanged water is performed, and solid-liquid separation is performed by Nutsche suction filtration. The resultant is re-dispersed in 3-liter ion exchanged water at 40° C. and stirred and washed for 15 minutes at 300 rpm. The solid-liquid separation and re-dispersion are further repeated 5 times. When electric conductivity of the filtrate is 9.7 μS/cm, solid-liquid separation is performed using a No. 4A paper filter by Nutsche suction filtration.

Surface Modification of Toner Particles 100 parts by weight of the obtained toner particles are added to 900 parts by weight of ion exchanged water to prepare a slurry (solid content concentration of 10% by weight). Hydrochloric acid of 1 N is added to the slurry, pH is adjusted to pH 4, stirring is performed for 10 minutes, the solid-liquid separation is performed by centrifugation, a supernatant liquid is taken out, and excessive acids are removed. Thereafter, 900 parts by weight of ion exchanged water are added, the resultant is turned into a slurry again, polyvinylamine PVAM-0595B (aqueous solution with weight average molecular weight of 100,000 and pH 12 manufactured by Mitsubishi Rayon Co., Ltd.) of 10% by weight aqueous solution of 10 parts by weight is added to the slurry, and the obtained material is stirred for 60 minutes. Thereafter, the solid-liquid separation is performed by centrifugation, a supernatant liquid is taken out, and excessive polyvinylamine is removed. Until electric conductivity of the washing solution becomes equal to or less than 20 μS/cm, addition of ion exchanged water, stirring for 10 minutes, and centrifugation is repeated. Filtration is performed using paper filter (No. 4A manufactured by Advantech Co., Ltd.), washing with ion exchanged water is performed, drying is performed at 35° C. for 24 hours, crushing is performed, and surface modifying toner particles are obtained.

Preparation of Liquid Developer 100 parts by weight of the obtained surface modifying toner particles are mixed with 233 parts by weight of silicone oil (dimethyl silicone 20 cs manufactured by Shin-Etsu Chemical Co., Ltd.), and the liquid developer with the solid content concentration of 30% by weight is obtained.

Detection of Polyvinylamine Compound

The detection of the polyvinylamine compound in the surface modifying toner particles is performed using an infrared spectrophotometer (FT/IR-4100 manufactured by JASCO Corporation). In an infrared absorption spectrum, regarding, the absorption of —$NH_2$, the polyvinylamine compound has an absorption characteristic near 3,500 $cm^{-1}$ to 3,300 $cm^{-1}$, 1,640 $cm^{-1}$ to 1,550 $cm^{-1}$. When the polyvinylamine compound has a —NHCHO group, the polyvinylamine compound has an absorption characteristic, regarding the absorption of —CHO, near 1,740 $cm^{-1}$ to 1,720 $cm^{-1}$.

In addition, the surface modifying toner particles may be extracted from a liquid developer by the following method. The liquid developer is precipitated by centrifugation (3,000 rpm×5 minutes), the supernatant liquid is taken out by decantation, and the toner particles are extracted. The polyvinylamine compound on the surface of the toner particles is separated by washing the extracted toner particles with alcohols, from the solution after washing, the weight average molecular weight Mw of the polyvinylamine compound is determined by using high speed liquid chromatography (HLC-8320GPC manufactured by Tosoh corporation), the content of the polyvinylamine compound is calculated by using an ultraviolet-visible near infrared spectrophotometer (UV-1800 model, manufactured by Shimadzu Corporation), and an acid value of the binder resin is calculated by using a potentiometric titrator (COM-1700 model, manufactured by Hiranuma Sangyo Corporation) by the method of JIS K0070. The acid value of the binder resin is 13 mg KOH/g.

Evaluation

Developing Properties

Liquid developer layers are formed with liquid developers obtained in each of examples and comparative examples on the developing roller of the image forming apparatus by using the image forming apparatus illustrated in the FIGURE. Subsequently, the developing roller and the photoreceptor are substantially uniformly charged so that the surface potential of the developing roller is set to be 300 V, the surface potential of the photoreceptor is 500 V, exposure is performed on the photoreceptor, and the charging on the surface of the photoreceptor is attenuated so that the surface potential becomes 50 V. The toner particles on the developing roller and the toner particles on the photoreceptor after the liquid developer layer passes through a portion between the photoreceptor and the developing roller are extracted with tape. The tape used in the extraction is attached to recording paper to measure concentrations of the respective toner particles. After the measurement, values obtained by dividing the concentrations of the toner particles extracted from the photoreceptor by the sum of the concentrations of the toner particles extracted from the photoreceptor and the concentrations of the toner particles extracted from the developing roller and multiplying the obtained value by 100 is obtained as development efficiency, and the values are evaluated on the basis of the following five-grade criteria. The results are presented in Table 1.

A: Development efficiency is equal to or greater than 96%, and development efficiency is especially excellent B: Development efficiency is equal to or greater than 91% and less than 96%, development efficiency is excellent C: Development efficiency is equal to or greater than 85% and less than 91%, there is no problem in practical use D: Development efficiency is equal to or greater than 55% and less than 85%, development efficiency is inferior E: Development efficiency is less than 55%, development efficiency is especially inferior Positively Charging Properties With respect to the liquid developers obtained in the respective examples and respective comparative examples, the potential differences are measured by using a "microscope type laser zeta-potential meter" ZC-3000 manufactured by Microtec Nition Co., Ltd. to evaluate the potential differences on the basis of the following five-grade criteria. The measurement is carried out by diluting the liquid developer with a diluent solvent, placing the dilution in a 10-mm transparent cell, applying a voltage of 300 V at a gap between electrodes of 9 mm, and simultaneously observing the speed of movement of the particles in the cell with a microscope. Thus, the speed of movement is calculated, and the zeta potential is determined from the speed of movement value. The results are presented in Table 1.

A: Potential difference is equal to or greater than +100 mV (very good)

B: Potential difference is equal to or greater than +85 mV and less than +100 mV (good)

C: Potential difference is equal to or greater than +70 mV and less than +85 mV (mediocre)

D: Potential difference is equal to or greater than +50 mV and less than +70 mV (slightly poor)

E: Potential difference is less than +50 mV (very poor)

Dispersion Stability

The liquid developer of 10 mL obtained in the respective examples and respective comparative examples is put into a test tube (diameter of 12 mm and length of 120 mm), and depths of the precipitation after the resultant stood for 14 days is measured to evaluate the values on the basis of the following five-grade criteria. The results are presented in Table 1.

A: Precipitation depth is 0 mm

B: Precipitation depth is greater than 0 mm and equal to or less than 2 mm

C: Precipitation depth is greater than 2 mm and equal to or less than 4 mm

D: Precipitation depth is greater than 4 mm and equal to or less than 6 mm

E: Precipitation depth is greater than 6 mm

Recycling Property

The liquid developers obtained in the respective examples and respective comparative examples are used, and images of predetermined patterns is formed respectively on recording paper (High quality paper $C^2$ manufactured by Fuji Xerox Co., Ltd.) of 50,000 sheets by the image forming apparatus as illustrated in the FIGURE. These images are formed while the supply of the liquid developers from the liquid developer tanks of the respective colors to corresponding stirring devices of the respective colors to is stopped. After the images are formed on the 50,000 sheets of recording paper, tests are performed on recycled liquid developers obtained by diluting the toner particles collected in the stirring devices with an insulating liquid so that the solid content containing ratio become 30% by weight, in the following method, and the adaptability to recycling (recycling properties) are evaluated.

Recycled liquid developers of 10 mL obtained in the respective examples and respective comparative examples are put into the test tube (diameter of 12 mm and length of 120 mm), and depths of the precipitation after the resultant is stood for 10 days is measured to evaluate the values on the basis of the following five-grade criteria. The results are presented in Table 1.

A: Precipitation depth is equal to or less than 1 mm

B: Precipitation depth is greater than 1 mm and equal to or less than 3 mm

C: Precipitation depth is greater than 3 mm and equal to or less than 5 mm

D: Precipitation depth is greater than 5 mm and equal to or less than 7 mm

E: Precipitation depth is greater than 7 mm

Example 2

The surface modifying toner particles and the liquid developer are obtained in the same manner as in Example 1 except that the amount of 10% by weight aqueous solution of polyvinylamine PVAM-05953 used is changed to 1 part by weight. Hereinafter, evaluations are performed in the same manner as in Example 1. The results are presented in Table 1.

Example 3

The surface modifying toner particles and the liquid developer are obtained in the same manner as in Example 1 except that the amount of 10% by weight aqueous solution of polyvinylamine PVAM-0595B used is changed to 30 parts by weight. Hereinafter, evaluations are performed in the same manner as in Example 1. The results are presented in Table 1.

Example 4

The surface modifying toner particles and the liquid developer are obtained in the same manner as in Example 1 except that polyvinylamine is changed to PVAM-0570B (aqueous solution manufactured by Mitsubishi Rayon Co., Ltd., weight average molecular weight of 40,000, x:y=88:12, and pH 9) which is a copolymer (hydrochloride) of vinylamine and N-vinyl formamide. Hereinafter, evaluations are performed in the same manner as in Example 1. The results are presented in Table 1.

Example 5

The surface modifying toner particles and the liquid developer are obtained in the same manner as in Example 1 except that the binder resins of the toner particles are changed to styrene/acrylic resins (manufactured by Fujikurakasei Co., Ltd., weight average molecular weight of 6,500). Hereinafter, evaluations are performed in the same manner as in Example 1. The results are presented in Table 1. The acid value of the binder resin is 10 mg KOH/g.

Example 6

The surface modifying toner particles and the liquid developer are obtained in the same manner as in Example 1 except that the amount of 10% by weight aqueous solution of polyvinylamine PVAM-0595B used is changed to 0.5 parts by weight. Hereinafter, evaluations are performed in the same manner as in Example 1. The results are presented in Table 1.

Example 7

The surface modifying toner particles and the liquid developer are obtained in the same manner as in Example 1 except that the amount of 10% by weight aqueous solution of polyvinylamine PVAM-0595B used is changed to 50 parts by weight. Hereinafter, evaluations are performed in the same manner as in Example 1. The results are presented in Table 1.

Example 8

The surface modifying toner particles and the liquid developer are obtained in the same manner as in Example 1 except that the amorphous polyester resin is synthesized as follows. In a reaction vessel, 618 parts by weight (11.0 mol) of a bisphenol A.PO2 mole adduct, 162 parts by weight (2.5 mol) of a bisphenol A.PO3 mole adduct, 241 parts by weight (9.0 mol) of a terephthalic acid, 13 parts by weight (0.5 mol) of an isophthalic acid, 12 parts by weight (0.5 mol) of an adipic acid, and 3 parts by weight of titanium diisopropoxy bis triethanolaminate as a condensation catalyst are input, reaction is performed for 5 hours at 230° C. under a nitrogen gas flow while formed water is distilled, reaction is performed under decompression in the range of 0.5 kPa to 2.5 kPa, and cooling is performed to 175° C. when the acid value is equal to or less than 2 mg KOH/g. Thereafter, 9 parts by weight (0.3 mol) of an anhydrous trimellitic acid is added, stood for 1 hour at 175° C., and extracted. The obtained resin is cooled to room temperature, and pulverized into particles. The glass transition temperature, the weight average molecular weight, and the resin acid value are measured in the same as in Example 1. The glass transition temperature is 58° C., the weight average molecular weight is 4,800, and the resin acid value is 1 mg KOH/g. Hereinafter, evaluations are performed in the same manner as in Example 1. The results are presented in Table 1.

Example 9

The surface modifying toner particles and the liquid developer are obtained in the same manner as in Example 1 except that the amorphous polyester resin is synthesized as follows. In a reaction vessel, 601 parts by weight (20.0 mol) of ethyleneglycol, 470 parts by weight (5.0 mol) of an terephthalic acid dimethylester, 402 parts by weight (5.0 mol) of an isophthalic acid, and 3 parts by weight of tetraisopropoxide titanate as a condensation catalyst are input, reaction is performed for 6 hours at 180° C. under a nitrogen gas flow while formed methanol is distilled. Subsequently, while the temperature is slowly increased to 230° C., and formed ethyleneglycol and water are distilled under a nitrogen gas flow, the reaction is performed for 4 hours, and reaction is performed for 2 hours under decompression in the range of 0.5 kPa to 2.5 kPa. The collected ethyleneglycol is 277 parts by weight (9.2 mol). Thereafter, cooling is performed to 175° C., 43 parts by weight (0.5 mol) of an anhydrous trimellitic acid is added, stand for 1 hour at 175° C., and extracted. The obtained resin is cooled to the room temperature, and pulverized into particles. The glass transition temperature, the weight average molecular weight, and the resin acid value are measured in the same as in Example 1. The glass transition temperature is 57° C., the weight average molecular weight is 5,800, and the resin acid value is 30 mg KOH/g. Hereinafter, evaluations are performed in the same manner as in Example 1. The results are presented in Table 1.

Example 10

The surface modifying toner particles and the liquid developer are obtained in the same manner as in Example 1 except that the amorphous polyester resin is synthesized as follows. In a reaction vessel, 721 parts by weight (10.4 mol) of a bisphenol A.EO2 mole adduct, 353 parts by weight (10.0 mol) of a terephthalic acid, and 3 parts by weight of dibutyltin oxide as a condensation catalyst are input, reaction is performed for 10 hours at 230° C. under a nitrogen gas flow while formed water is distilled, and reaction is performed under decompression in the range of 0.5 kPa to 2.5 kPa. The obtained resin is cooled to the room temperature, and pulverized into particles. The glass transition temperature, the weight average molecular weight, and the resin acid value are measured in the same as in Example 1. The glass transition temperature is 55° C., the weight average molecular weight is 5,000, and the resin acid value is 0.5 mg KOH/g. Hereinafter, evaluations are performed in the same manner as in Example 1. The results are presented in Table 1.

Example 11

The surface modifying toner particles and the liquid developer are obtained in the same manner as in Example 1 except that the amorphous polyester resin is synthesized as follows. In a reaction vessel, 599 parts by weight (11.5 mol) of a bisphenol A.PO2 mole adduct, 150 parts by weight (2.5 mol) of a bisphenol A.PO3 mole adduct, 174 parts by weight (7.0 mol) of a terephthalic acid, 25 parts by weight (1.0 mol) of an isophthalic acid, 44 parts by weight (2.0 mol) of an adipic acid, and 3 parts by weight of tetrabutoxy titanate as a condensation catalyst are input, reaction is performed for 5 hours at 230° C. under a nitrogen gas flow while formed water is distilled, reaction is performed under decompression in the range of 0.5 kPa to 2.5 kPa, and cooling is performed to 170° C. when the resin acid value is 2 mg KOH/g. Thereafter, 60 parts by weight (2.1 mol) of an anhydrous trimellitic acid are added, stood for 1 hour at 170° C., and extracted. The obtained resin is cooled to the room temperature, and pulverized into particles. The glass transition temperature, the weight average molecular weight, and the resin acid value are measured in the same as in Example 1. The glass transition temperature is 56° C., the weight average molecular weight is 4,300, and the resin acid value is 35 mg KOH/g. Hereinafter, evaluations are performed in the same manner as in Example 1. The results are presented in Table 1.

Comparative Example 1

The surface modifying toner particles and the liquid developer are obtained in the same manner as in Example 1 except that polyvinylamine is not used. Hereinafter, evaluations are performed in the same manner as in Example 1. The results are presented in Table 1.

Comparative Example 2

A sample of the liquid developer is prepared in the same manner as in Example 1 except that, instead of polyvinylamine, quarternary ammonium salt (BONTRON P-51 manufactured by Orient Chemical Industries Co., Ltd.) of 2 part by weight for yellow, magenta, cyan pigments, and quarternary ammonium salt of 1 parts by weight for a black pigment are used and mixed into toner particles after drying, and evaluation is performed. The results are presented in Table 1.

Preparation of Dry Developer

Example 12

A dry developer is obtained by mixing 10 parts by weight of surface modifying toner particles obtained in Example 1 with a positively chargeable carrier (Standard carrier P-01 of The Imaging Society of Japan) of 190 parts by weight.

Comparative Example 3

The dry developer is obtained by mixing 10 parts by weight of the toner particles obtained in Comparative Example 1 with a positively chargeable carrier (Standard carrier P-01 of The Imaging Society of Japan) of 190 parts by weight.

Comparative Example 4

A dry developer is obtained by mixing 10 parts by weight of the surface modifying toner particles obtained in Comparative Example 2 with a positively chargeable carrier (Standard carrier P-01 of The Imaging Society of Japan) of 190 parts by weight.

Developing Properties of Dry Developer

Developing devices of a reformed machine of DocuCentre Color 400CP manufactured by Fuji Xerox Co., Ltd. (a machine which is reformed so that a process speed of a fixing unit may be controlled by an external power controller) are filled up with respective developers of Example 12 and Comparative Examples 3 and 4 under the environment of 25° C. and 50% RH, 10,000 sheets of white solid images are printed on A4 paper (J paper) manufactured by Fuji Xerox Co., Ltd., a solid badge of 5 cm×2 cm is developed, a development toner image of a photoreceptor surface are extracted by using adhesiveness on a surface of an adhesive tape, and a weight thereof (W1) are measured. Subsequently, the same development toner image is transferred to a surface of paper (J paper), and the weight (W2) of the transferred image is measured. From the results, the transfer efficiency is determined by the expression below and evaluated according to the evaluation criteria. The results are presented in Table 1.

$$\text{Transfer efficiency (\%)}=(W2/W1)\times 100$$

Evaluation Criteria of Development Efficiency

A: Transfer efficiency is equal to or greater than 95%

B: Transfer efficiency is equal to or greater than 87.5% and less than 95%

C: Transfer efficiency is equal to or greater than 80% and less than 87.5%

D: Transfer efficiency is less than 80%

Positively Charging Properties of Dry Developer

The developing devices described above is filled up with respective developers of Example 12 and Comparative Examples 3 and 4, charge amounts of toners regulated by regulation blades of the developing devices and transported to the photoreceptor are evaluated by analyzing toners on the developing rollers. The charge amounts are measured by an E-SPART analyzer manufactured by Hosokawa Micron Corp. A measurement condition is a flow rate of 0.2 liters/minutes, dust collecting air flow rate of 0.6 liters/minutes, and spraying nitrogen gas pressure of 0.02 Mpa, an charge amount (Q/m) for each toner is measured, and charge amount distribution is obtained with 3,000 toner counts. The results are presented in Table 1.

With respect to the uniformity of charge amounts of toners, in a number distribution of a charge amount for each toner, as an absolute value of the difference between a chargecharge amount of maximum frequency (Q1/m1) and the value (Q2/m2) obtained by dividing total charge amount of the measured toners by a measured counts (number of toners) is smaller, the distribution of the charge amount is uniform, and as the absolute value is larger, the distribution is not uniform.

Evaluation Criteria of Charging Characteristic

A: Absolute value of difference is less than 0.8

B: Absolute value of difference is equal to or greater than 0.8 and less than 1.0

C: Absolute value of difference is equal to or greater than 1.0 and less than 1.5

D: Absolute value of difference is equal to or greater than 1.5

TABLE 1

| | Binder resin | Resin acid value [mg KOH/g] | Colorant | Surface modifying agent | Additives (% by weight of toner) | Developing property | Positively charging property | Dispersion stability | Recycling property |
|---|---|---|---|---|---|---|---|---|---|
| Example 1 | Polyester | 13 | YMCK | PVAM-0595B | 1 | A | A | A | A |
| Example 2 | Polyester | 13 | YMCK | PVAM-0595B | 0.1 | B | B | A | A |
| Example 3 | Polyester | 13 | YMCK | PVAM-0595B | 3 | A | A | B | B |
| Example 4 | Polyester | 13 | YMCK | PVAM-0570B | 1 | B | A | A | A |
| Example 5 | Stylene/acryl | 10 | YMCK | PVAM-0595B | 1 | B | B | B | B |
| Example 6 | Polyester | 13 | YMCK | PVAM-0595B | 0.05 | C | C | B | B |
| Example 7 | Polyester | 13 | YMCK | PVAM-0595B | 5 | B | B | C | C |
| Example 8 | Polyester | 1 | YMCK | PVAM-0595B | 1 | C | C | C | C |
| Example 9 | Polyester | 30 | YMCK | PVAM-0595B | 1 | C | C | C | C |
| Example 10 | Polyester | 0.5 | YMCK | PVAM-0595B | 1 | C | D | C | C |
| Example 11 | Polyester | 35 | YMCK | PVAM-0595B | 1 | C | D | C | C |
| Example 12 | Polyester | 13 | YMCK | PVAM-0595B | 1 | A | A | — | — |
| Comparative Example 1 | Polyester | 13 | YMCK | — | — | E | E | E | E |
| Comparative Example 2 | Polyester | 13 | YMCK | BONTRON P-51 | 2 (YMC), 1 (K) | E | E | E | E |
| Comparative Example 3 | Polyester | 13 | YMCK | — | — | D | D | — | — |
| Comparative Example 4 | Polyester | 13 | YMCK | BONTRON P-51 | 2 (YMC), 1 (K) | D | D | — | — |

As shown above, in examples of using toner particles of which surfaces are processed with the polyvinylamine compound, positively charging properties is excellent compared with the comparative examples. In addition, in the examples, the developing properties, the dispersion stability, and the recycling properties are excellent compared with the comparative examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A positively chargeable toner comprising:

at least a binder resin; and toner particles of which surfaces are modified by a polyvinylamine compound, wherein the polyvinylamine compound is polyvinylamine represented by Formula(1):

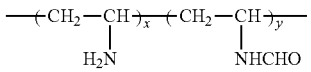

(1)

wherein in Formula (1), x and y are independently integers equal to or greater than 1, respectively, and wherein the amino group in the formula (I) may have an acid salt structure.

2. The positively chargeable toner according to claim 1, wherein an acid value of the binder resin is in a range of 1 mg KOH/g to 30 mg KOH/g.

3. The positively chargeable toner according to claim 2, wherein a content of the polyvinylamine compound is in a range of 0.1% by weight to 3% by weight with respect to all toner particles.

4. The positively chargeable toner according to claim 1, wherein a content of the polyvinylamine compound is in a range of 0.1% by weight to 3% by weight with respect to all toner particles.

5. A liquid developer comprising:

the positively chargeable toner according to claim 1; and a carrier liquid.

6. An image forming method comprising:

forming a latent image on a surface of an image holding member;

developing the latent image formed on the surface of the image holding member by the liquid developer according to claim 5 to form a toner image;

transferring the toner image formed on the surface of the image holding member to the recording medium; and forming a fixed image by fixing the toner image transferred to the recording medium on the recording medium.

7. A developer comprising:

the positively chargeable toner according to claim 1.

8. An image forming method comprising:

forming a latent image on a surface of an image holding member;

developing the latent image formed on the surface of the image holding member by the developer according to claim 7 to form a toner image;

transferring the toner image formed on the surface of the image holding member to the recording medium; and forming a fixed image by fixing the toner image transferred to the recording medium on the recording medium.

9. A developer cartridge comprising a the liquid developer comprising:

the positively chargeable toner according to claim 1; and a carrier liquid, or a developer comprising:

the positively chargeable toner.

10. A process cartridge comprising a liquid developer comprising:

the positively chargeable toner according to claim 1; and a carrier liquid, or a developer comprising:

the positively chargeable toner.

* * * * *